US011075464B2

(12) United States Patent
Biancotto et al.

(10) Patent No.: US 11,075,464 B2
(45) Date of Patent: Jul. 27, 2021

(54) PARABOLIC REFLECTOR ANTENNAS HAVING FEEDS WITH ENHANCED RADIATION PATTERN CONTROL

(71) Applicant: CommScope Technologies LLC, Hickory, NC (US)

(72) Inventors: Claudio Biancotto, Edinburgh (GB); Ronald J. Brandau, Homer Glen, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/649,294

(22) PCT Filed: Aug. 21, 2018

(86) PCT No.: PCT/US2018/047156
§ 371 (c)(1),
(2) Date: Mar. 20, 2020

(87) PCT Pub. No.: WO2019/060072
PCT Pub. Date: Mar. 28, 2019

(65) Prior Publication Data

US 2020/0280135 A1 Sep. 3, 2020

Related U.S. Application Data

(60) Provisional application No. 62/561,816, filed on Sep. 22, 2017.

(51) Int. Cl.
*H01Q 15/08* (2006.01)
*H01Q 5/10* (2015.01)
(Continued)

(52) U.S. Cl.
CPC ..... *H01Q 15/08* (2013.01); *H01Q 5/10* (2015.01); *H01Q 5/47* (2015.01); *H01Q 15/16* (2013.01); *H01Q 19/193* (2013.01)

(58) Field of Classification Search
CPC .... H01Q 19/193; H01Q 19/134; H01Q 15/16; H01Q 19/19; H01Q 19/18; H01Q 13/065;
(Continued)

(56) References Cited

U.S. PATENT DOCUMENTS 2,617,029 A * 11/1952 Plummer ..... H01Q 3/18 343/761
6,081,170 A * 6/2000 Enokuma ..... H01Q 5/47 333/134

(Continued)

FOREIGN PATENT DOCUMENTS

WO 93/13570 7/1993

OTHER PUBLICATIONS

International Search Report and Written Opinion of the International Searching Authority corresponding to International Application No. PCT/US2018/047156 (14 pages) (dated Dec. 19, 2018).

*Primary Examiner* — Vibol Tan
(74) *Attorney, Agent, or Firm* — Myers Bigel, P.A.

(57) ABSTRACT

Parabolic reflector antennas advantageously utilize feed boom mounted dielectric lens structures to support enhanced radiation pattern control. A parabolic reflector antenna includes a dish reflector, a feed boom waveguide having a proximal end coupled to the dish reflector, a sub-reflector assembly and a dielectric lens. The sub-reflector assembly may include a dielectric block coupled to a distal end of the feed boom waveguide and a sub-reflector adjacent a distal end of the dielectric block. The dielectric lens may be provided on the feed boom waveguide at a location intermediate the proximal and distal ends of the feed boom waveguide.

16 Claims, 8 Drawing Sheets

(51) Int. Cl.
*H01Q 15/16* (2006.01)
*H01Q 19/19* (2006.01)
*H01Q 5/47* (2015.01)

(58) Field of Classification Search
CPC .. H01Q 1/1228; H01Q 13/02; H01Q 13/0266; H01Q 13/06; H01Q 15/14; H01Q 19/132; H01Q 1/528
See application file for complete search history.

(56) References Cited

U.S. PATENT DOCUMENTS

| | | | | |
|---|---|---|---|---|
| 6,137,449 | A | 10/2000 | Kildal | |
| 6,724,349 | B1 * | 4/2004 | Baird | H01Q 19/134 343/781 CA |
| 6,919,855 | B2 | 7/2005 | Hills | |
| 8,581,795 | B2 | 11/2013 | Simms et al. | |
| 9,019,164 | B2 * | 4/2015 | Brandau | H01Q 19/193 343/781 P |
| 9,634,400 | B2 * | 4/2017 | Zelenski | H01Q 13/02 |
| 2004/0257290 | A1 | 12/2004 | Gothard et al. | |
| 2005/0099350 | A1 | 5/2005 | Gothard et al. | |
| 2010/0188304 | A1 * | 7/2010 | Clymer | H01Q 13/0258 343/753 |
| 2012/0287007 | A1 * | 11/2012 | Hills | H01Q 19/021 343/781 P |
| 2013/0300621 | A1 * | 11/2013 | Brandau | H01Q 15/16 343/781 CA |
| 2015/0091768 | A1 | 4/2015 | Zelenski | |

* cited by examiner

PARABOLIC REFLECTOR ANTENNAS HAVING FEEDS WITH ENHANCED RADIATION PATTERN CONTROL

REFERENCE TO PRIORITY APPLICATIONS

This application is a 35 U.S.C. § 371 national stage application of PCT International Application No. PCT/US2018/047156, filed Aug. 21, 2018, which claims priority to U.S. Provisional Application Ser. No. 62/561,816, filed Sep. 22, 2017, the disclosures of each are hereby incorporated herein by reference. The above-referenced PCT International Application was published in the English language as International Publication No. WO 2019/060072 A1 on Mar. 28, 2019.

FIELD OF THE INVENTION

The present invention relates to reflector antennas utilizing deep dish or shallow dish parabolic reflectors and, more particularly, to reflector antennas having improved control of signal radiation pattern characteristics.

BACKGROUND

Dual reflector antennas employing self-supported feeds direct a received signal, which is incident on the main reflector, onto a sub-reflector mounted adjacent to the focal region of the main reflector, which in turn directs the signal into a waveguide transmission line typically via a feed horn or aperture to the first stage of a receiver. When the dual reflector antenna is used to transmit a signal, the signals travel from the last stage of the transmitter system, via the waveguide, to the feed aperture, sub-reflector, and main reflector to free space.

The electrical performance of a reflector antenna is typically characterized by its gain, radiation pattern, cross-polarization and return loss performance. Efficient gain, radiation pattern and cross-polarization characteristics may be important for efficient microwave link planning and coordination, while a good return loss may be important for efficient radio operation. The above characteristics are determined by a feed system designed in conjunction with the main reflector profile.

Deep dish reflectors are reflector dishes in which the ratio of the reflector focal length (F) to reflector diameter (D) (i.e., F/D ratio) is made less than or equal to 0.25, whereas shallow dish reflectors have an F/D ratio of greater than 0.25. Deep dish designs can achieve improved radiation pattern characteristics without the need for a separate shield assembly when used with a carefully designed feed system which provides controlled dish illumination, particularly toward the edge of the dish. In contrast, shallow dish reflectors may utilize shield assemblies to achieve improved radiation characteristics. Examples of shield assemblies are disclosed in commonly owned U.S. Pat. No. 8,581,795 to Simms et al. and U.S. Pat. No. 9,019,164 to Brandau et al., the disclosures of which are hereby incorporated herein by reference.

An example of a dielectric cone feed sub-reflector configured for use with a dual reflector antenna is disclosed in commonly owned U.S. Pat. No. 6,919,855 to Hills ("the '855 patent"), the disclosure of which is hereby incorporated herein by reference. As disclosed by the '855 patent, a dual reflector antenna may utilize a generally conical dielectric block cone feed with a sub-reflector surface and a leading cone surface having a plurality of downward angled non-periodic perturbations concentric about a longitudinal axis of the dielectric block. The cone feed and sub-reflector dimensions are made to be relatively small to reduce blockage of the signal path from the reflector dish to free space.

FIG. 1 is a partially-exploded, rear perspective view of a conventional microwave antenna system 10 that uses a parabolic reflector antenna. As shown in FIG. 1, the antenna system 10 includes a parabolic reflector antenna 20, a feed assembly 30 and a hub 50. The parabolic reflector antenna 20 may comprise, for example, a dish-shaped structure that is formed of metal or that has a metal inner surface (the inner metal surface of antenna 20 is not visible in FIG. 1). The hub 50 may be used to mount the parabolic reflector antenna 20 on a mounting structure (not shown) such as a pole, antenna tower, building or the like. The hub 50 may be mounted on the rear surface of the parabolic reflector antenna 20 by, for example, mounting screws. The hub 50 may include a hub adapter 52. A transition element 54 may be received within the hub adapter 52. The transition element 54 may be designed to efficiently launch RF signals received from, for example, a radio (not shown) into the feed assembly 30. The transition element 54 may comprise, for example, a rectangular-to-circular waveguide transition that is impedance matched for a specific frequency band.

An opening or bore 22 is provided at the middle (bottom) of the dish-shaped antenna 20. The hub adapter 52 may be received within this bore 22. The transition element 54 includes a bore 56 that receives the feed assembly 30. The feed assembly 30 may comprise, for example, a cylindrical waveguide 32 and a sub-reflector 40. The cylindrical waveguide 32 may have a tubular shape and may be formed of a metal such as, for example, aluminum. When the feed assembly 30 is mounted in the hub adapter 52 and the hub adapter 52 is received within the bore 22, a base of the cylindrical waveguide 32 may be proximate the bore 22, and a distal end of the cylindrical waveguide 32 and the sub-reflector 40 may be in the interior of the parabolic reflector antenna 20. A low-loss dielectric block 34 may be inserted into the distal end of the cylindrical waveguide 32. A distal end of the low-loss dielectric block 34 may have, for example, a stepped generally cone-like shape. The sub-reflector 40 may be mounted on the distal end of the dielectric block 34. In some cases, the sub-reflector 40 may be a metal layer that is sprayed, brushed, plated or otherwise formed on a surface of the dielectric block 34. In other cases, the sub-reflector 40 may comprise a separate element that is attached to the dielectric block 34. The sub-reflector 40 is typically made of metal and is positioned at a focal point of the parabolic reflector antenna 20. The sub-reflector 40 is designed to reflect microwave energy emitted from the cylindrical waveguide 32 onto the interior of the parabolic reflector antenna 20, and to reflect and focus microwave energy that is incident on the parabolic reflector antenna 20 into the distal end of the cylindrical waveguide 32.

Microwave antenna systems have been provided that operate in multiple frequency bands. For example, the UMX® microwave antenna systems sold by. CommScope, Inc. of Hickory, N.C. operate in two separate microwave frequency bands. These antennas include multiple waveguide feeds, each of which directly illuminates a parabolic reflector antenna. Other dual-band designs have been proposed where a first feed directly illuminates a parabolic reflector antenna and a second feed illuminates the parabolic reflector antenna via a sub-reflector. In addition, U.S. Pat.

No. 6,137,449 to P. Kildal discloses a dual-band reflector antenna design with a coaxial waveguide feed structure.

SUMMARY OF THE INVENTION

Parabolic reflector antennas according to embodiments of the invention advantageously utilize feed boom mounted dielectric lens structures to support enhanced radiation pattern control. According to some of these embodiments of the invention, a parabolic reflector antenna includes a dish reflector, a feed boom waveguide having a proximal end coupled to the dish reflector, a sub-reflector assembly and a dielectric lens. The sub-reflector assembly may include a dielectric block coupled to a distal end of the feed boom waveguide and a sub-reflector adjacent a distal end of the dielectric block. In addition, the dielectric lens may be provided on the feed boom waveguide at a location intermediate the proximal and distal ends of the feed boom waveguide.

According to some of these embodiments of the invention, the feed boom waveguide is a dual-band waveguide and is in coaxial alignment with the dielectric lens, which may be annular-shaped. In particular, the feed boom waveguide may include inner and outer waveguides in coaxial alignment, and the dielectric lens may be configured to surround a portion of the inner waveguide. The dielectric lens may also be configured to include an alignment spacer (for assembly alignment), which extends between the inner and outer waveguides. This alignment spacer may be annular-shaped and may extend between an outer cylindrical surface of the inner waveguide and an inner cylindrical surface of the outer waveguide. The cylindrically-shaped outer waveguide may also include an outwardly projecting and annular-shaped shoulder at its distal end, which is closest to the sub-reflector assembly.

According to further embodiments of the invention, a first portion of the dielectric block may be matingly received within a distal end of the inner waveguide, and the dielectric lens may surround the first portion of the dielectric block. In alternative embodiments of the invention, the feed boom waveguide includes inner and outer waveguides in coaxial alignment with the dielectric lens, but the dielectric lens is mounted on (and surrounds) a portion of the outer surface of the outer waveguide. The dielectric lens may be formed of a dielectric material, such as a cross-linked polystyrene material.

According to additional embodiments of the invention, a microwave antenna subassembly is provided, which includes a dual-band waveguide, a dielectric lens on a portion of the dual-band waveguide, and a sub-reflector assembly coupled to a distal end of the dual-band waveguide. This dual-band waveguide may include inner and outer waveguides in coaxial alignment, and the dielectric lens may surround a portion of the inner waveguide located adjacent the distal end. This dielectric lens may also include an annular-shaped alignment spacer, which may be inserted between the inner and outer waveguides during assembly.

According to further aspects of these embodiments, the sub-reflector assembly may include: (i) a dielectric block coupled to the distal end of the dual-band waveguide and (ii) a sub-reflector adjacent a distal end of the dielectric block. The maximum outer diameter of the dielectric lens may also be greater than a maximum outer diameter of the dielectric block. In addition, a first portion of the dielectric block may be matingly received within a distal end of the inner waveguide and the dielectric lens may surround this first portion of the dielectric block. The outer waveguide may also be cylindrically shaped and include an outwardly projecting and annular-shaped shoulder at its distal end, which is located adjacent the dielectric lens.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION OF EMBODIMENTS

Figure 1:
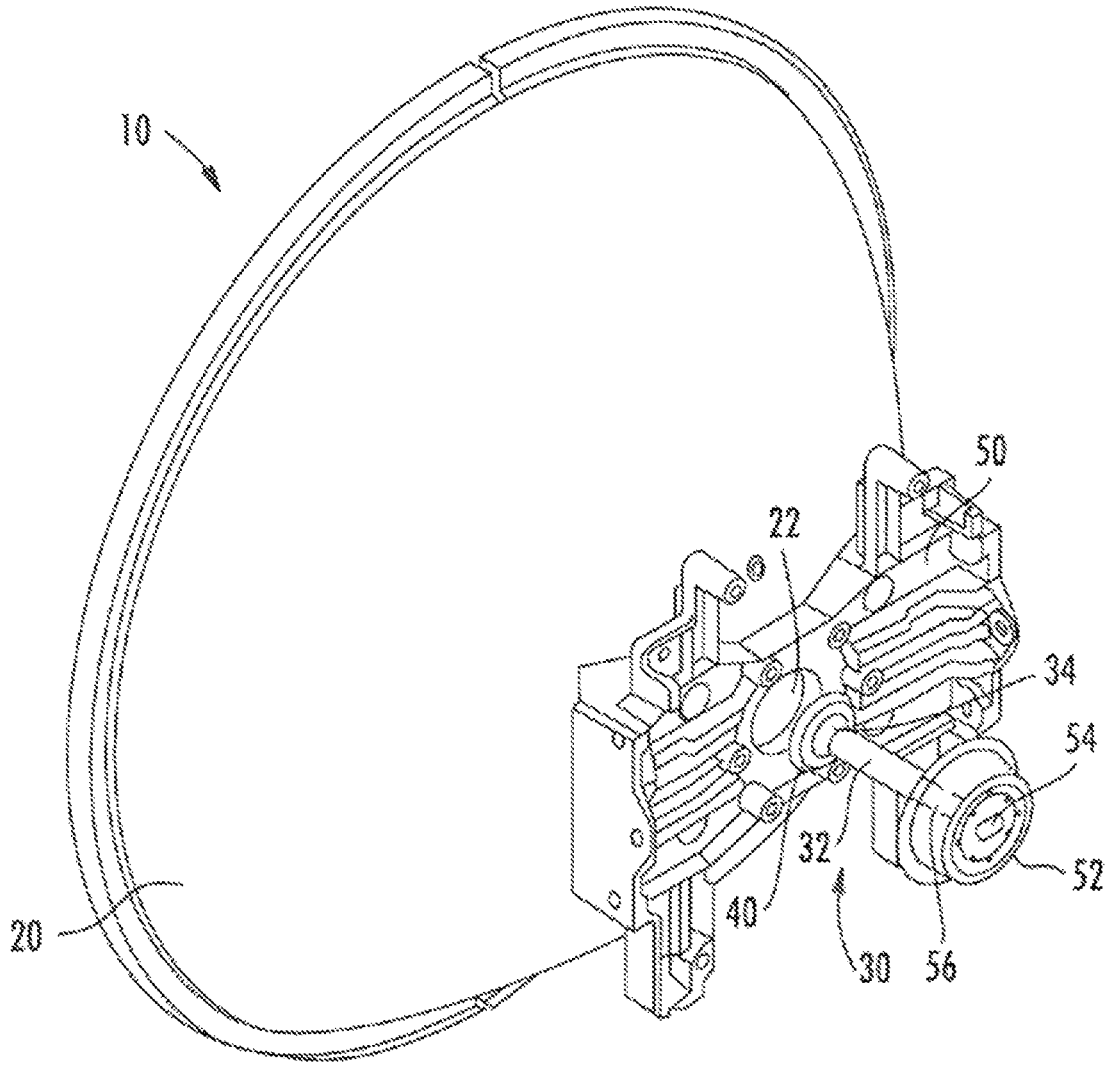
Fig. 1 (Prior Art)
FIG. 1 is a partially-exploded, rear perspective view of a microwave antenna system according to the prior art.

The present invention now will be described more fully with reference to the accompanying drawings, in which preferred embodiments of the invention are shown. This invention may, however, be embodied in many different forms and should not be construed as being limited to the embodiments set forth herein; rather, these embodiments are provided so that this disclosure will be thorough and complete, and will fully convey the scope of the invention to those skilled in the art. Like reference numerals refer to like elements throughout.

It will be understood that, although the terms first, second, third, etc. may be used herein to describe various elements, components and/or regions, these elements, components and/or regions should not be limited by these terms. These terms are only used to distinguish one element, component and/or region from another element, component and/or region. Thus, a first element, component and/or region discussed below could be termed a second element, component and/or region without departing from the teachings of the present invention.

The terminology used herein is for the purpose of describing particular embodiments only and is not intended to be limiting of the present invention. As used herein, the singular forms "a," "an" and "the" are intended to include the plural forms as well, unless the context clearly indicates otherwise. It will be further understood that the terms "comprising", "including", "having" and variants thereof, when used in this specification, specify the presence of stated features, steps, operations, elements, and/or components, but do not preclude the presence or addition of one or more other features, steps, operations, elements, components, and/or groups thereof. In contrast, the term "consisting of" when used in this specification, specifies the stated features, steps, operations, elements, and/or components, and precludes additional features, steps, operations, elements and/or components.

Figure 2A:
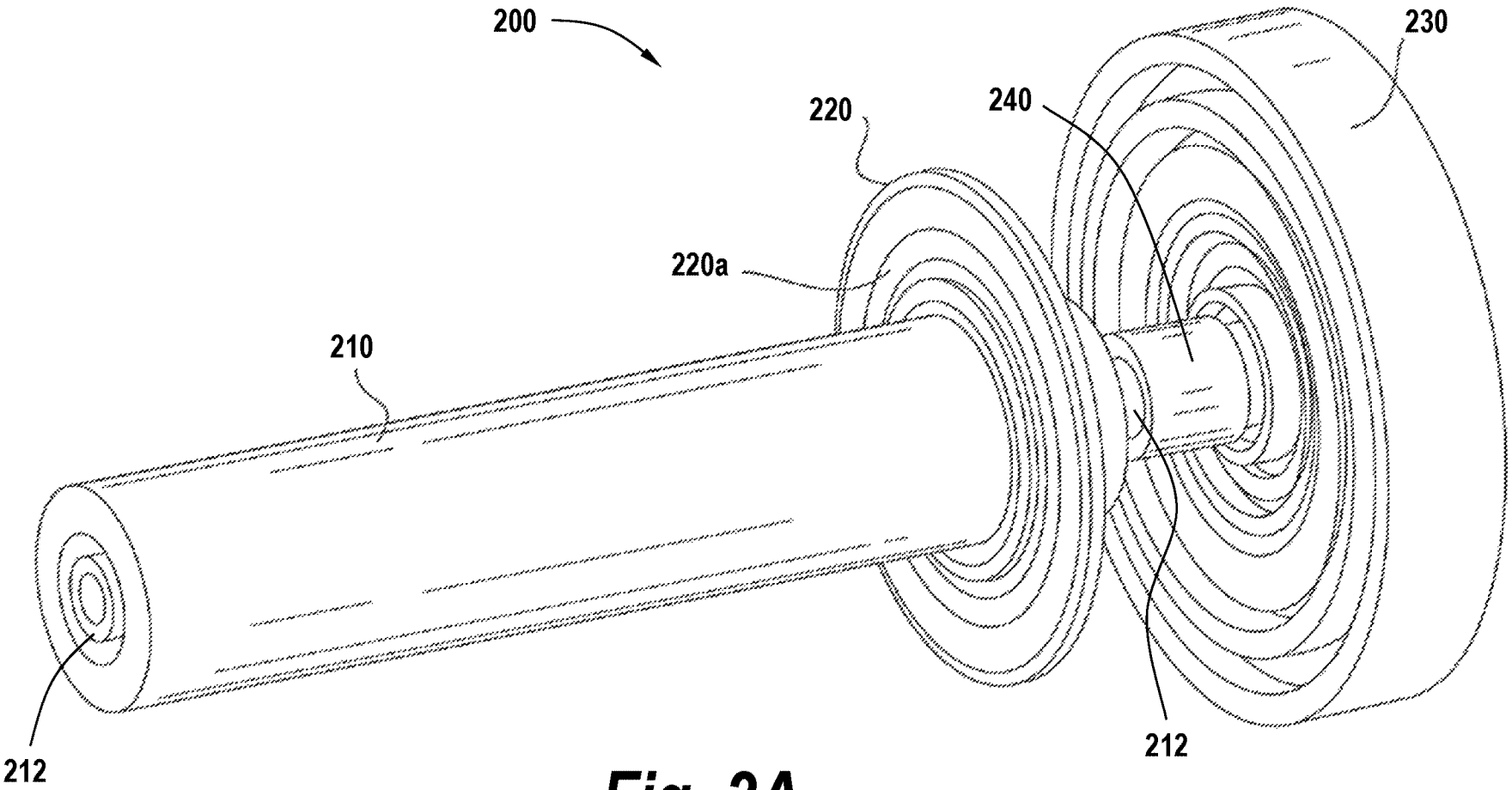
FIG. 2A is a perspective view of a coaxial waveguide structure with dielectric lens, according to an embodiment of the present invention.
Figure 2B:
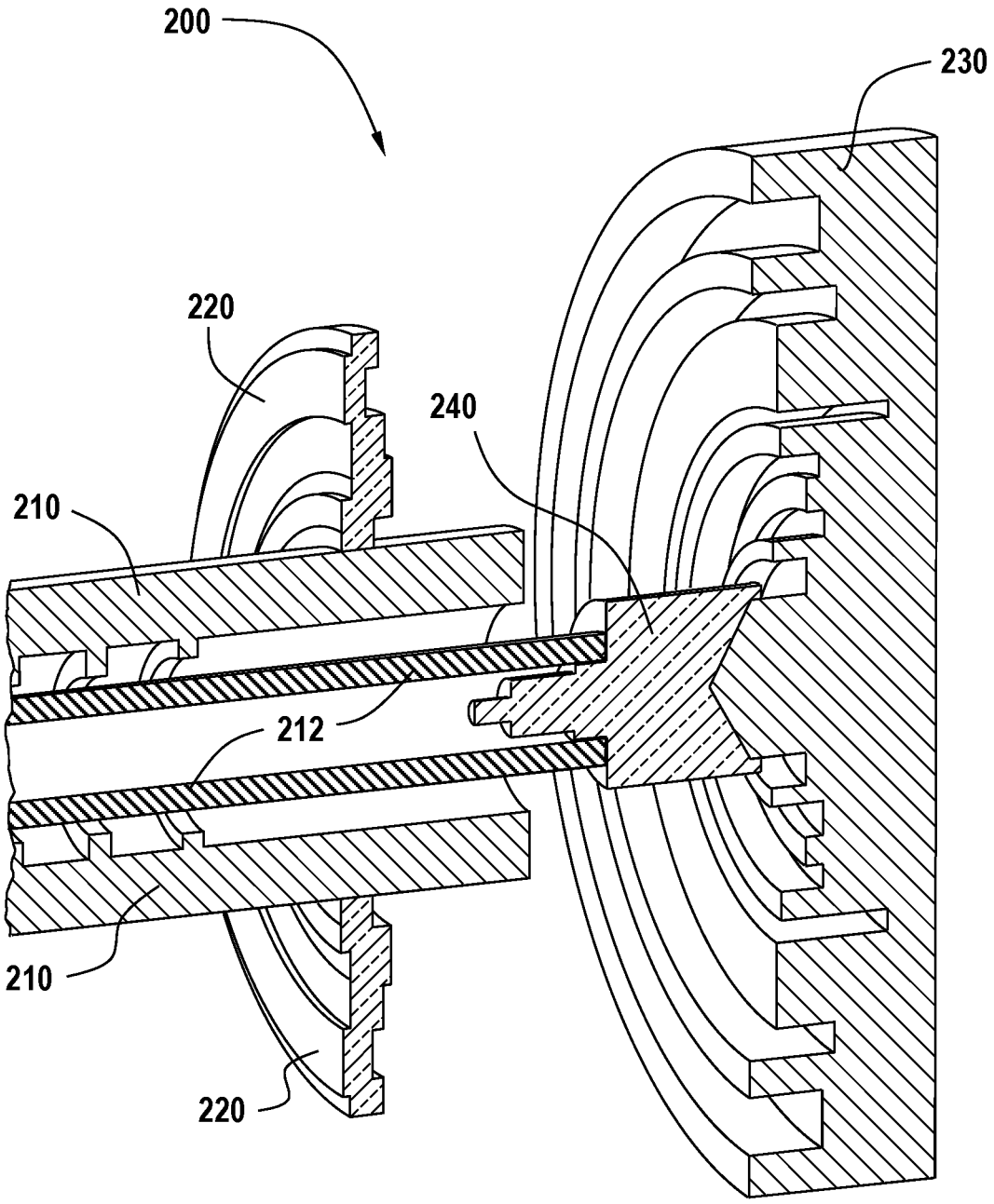
FIG. 2B is a cross-sectional view of an end portion to the coaxial waveguide structure and dielectric lens of FIG. 2A.
Figure 2C:
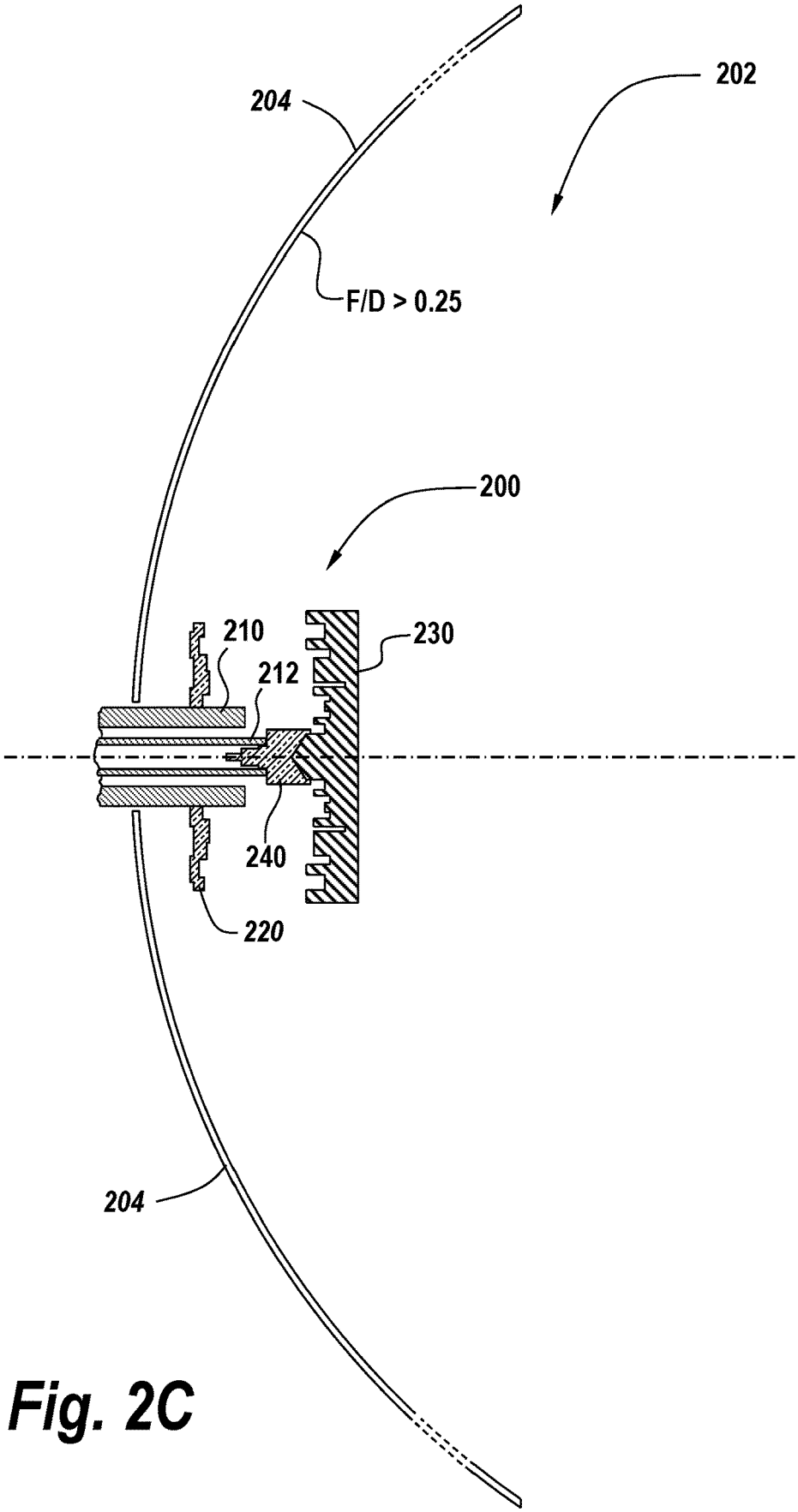
FIG. 2C is a cross-sectional view of a parabolic reflector antenna containing the coaxial waveguide structure and dielectric lens of FIGS. 2A-2B, according to an embodiment of the present invention.

Referring now to FIGS. 2A-2C, a parabolic reflector antenna 202 with microwave antenna subassembly 200 is illustrated as including a relatively shallow parabolic dish reflector 204 (F/D>0.25), a feed boom waveguide (210, 212) having a proximal end coupled to the dish reflector 204 and a sub-reflector assembly (230, 240) coupled to a distal end of the feed boom waveguide. This sub-reflector assembly is illustrated as including a dielectric block 240 and a metal sub-reflector 230 adjacent a distal end of the dielectric block 240. An annular-shaped dielectric lens 220, with one or more grooves 220*a*, is also provided on the feed boom waveguide (210, 212) at a location intermediate the proximal and distal ends thereof, but typically closer to the distal end of the feed boom waveguide. The dielectric lens 220 and the feed boom waveguide, which is shown as a dual-band waveguide containing an inner "higher frequency" waveguide 212 and outer "lower frequency" waveguide 210, are in coaxial alignment.

The dielectric lens 220 may be formed of a low-loss dielectric material such as, for example, a high grade polystyrene material (e.g., Laquerene) or a cross-linked polystyrene material (e.g., Rexolite®), and may be formed by machining from a solid block or by molding. The dielectric lens 220 may focus microwave energy incident thereon and/or may scatter/spread microwave energy incident thereon. Different portions of the dielectric lens 220 may be designed to operate differently by performing different functions. For example, the dielectric lens 220 may be designed so that when the antenna 202 is transmitting signals it controls the radiation that is passed from the sub-reflector 230 to the dish reflector 204 so that the radiation impinges on the main parabolic reflector in a desired manner (e.g., in a manner that produces a tightly focused antenna beam with little spillover of radiation outside the periphery of the main parabolic reflector and with little illumination of portions of the main parabolic reflector that are shielded by the sub-reflector 230). Alternatively, when the antenna 202 is receiving signals, the dielectric lens 220 may control the radiation that is passed from the dish reflector 204 to the sub-reflector 230 so that the radiation impinges on the sub-reflector 230 in a desired manner (e.g., in a manner that focuses the radiation onto the sub-reflector 230 in a manner that will efficiently pass the radiation to the coaxial waveguide structure 210, 212).

Figure 2D:
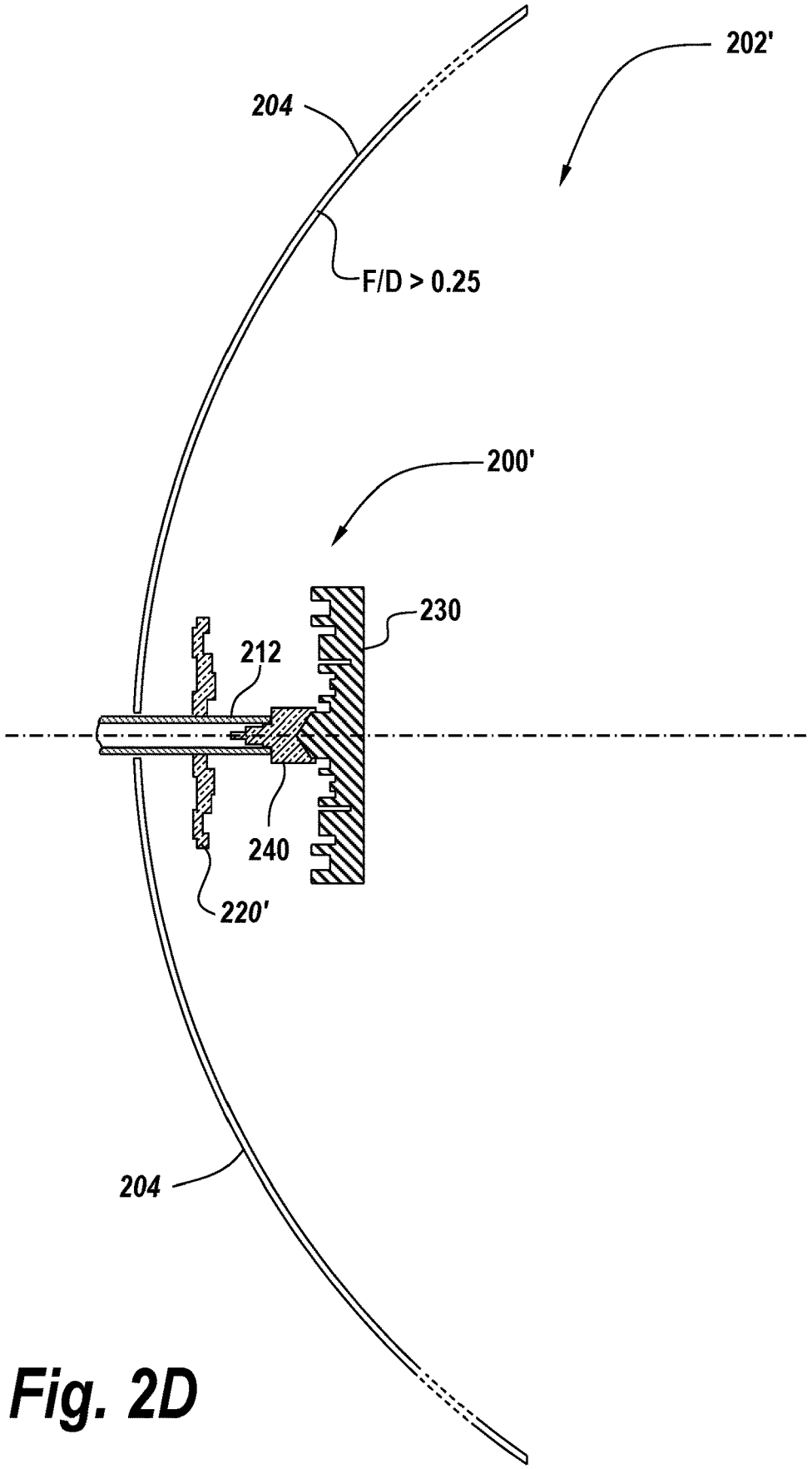
FIG. 2D is a cross-sectional view of a parabolic reflector antenna containing a feed boom waveguide and dielectric lens, according to an embodiment of the present invention.

One issue that may occur with a dual-band parabolic reflector antenna is that it may be difficult to design a feed boom structure that works well for both frequency bands. This may be particularly true when the two frequency bands are widely separated in frequency. Fortunately, the dielectric lens 220 can be configured to operate differently on microwave signals in the two different frequency bands, as the effect of the dielectric lens 220 on incident microwave energy is a function of the wavelength of the microwave signals. The dielectric lens 220 may include concentric rings having different thicknesses that are provided by forming grooves 220*a* and/or projections in an annular disk of dielectric material. These concentric rings of different thickness may be used advantageously to shape the radiation patterns in the two different frequency bands. In this manner, the inclusion of a dielectric lens 220 may provide another degree of freedom when designing an antenna to perform well across multiple frequency bands. Moreover, as shown by FIG. 2D, a dielectric lens 220' may be utilized as part of a "single waveguide" antenna subassembly 200' within a parabolic antenna 202', to thereby enhance the focusing of the radiation patterns therein, particularly for wider band feeds and possibly non-standard shaped dish reflectors.

Figure 3A:
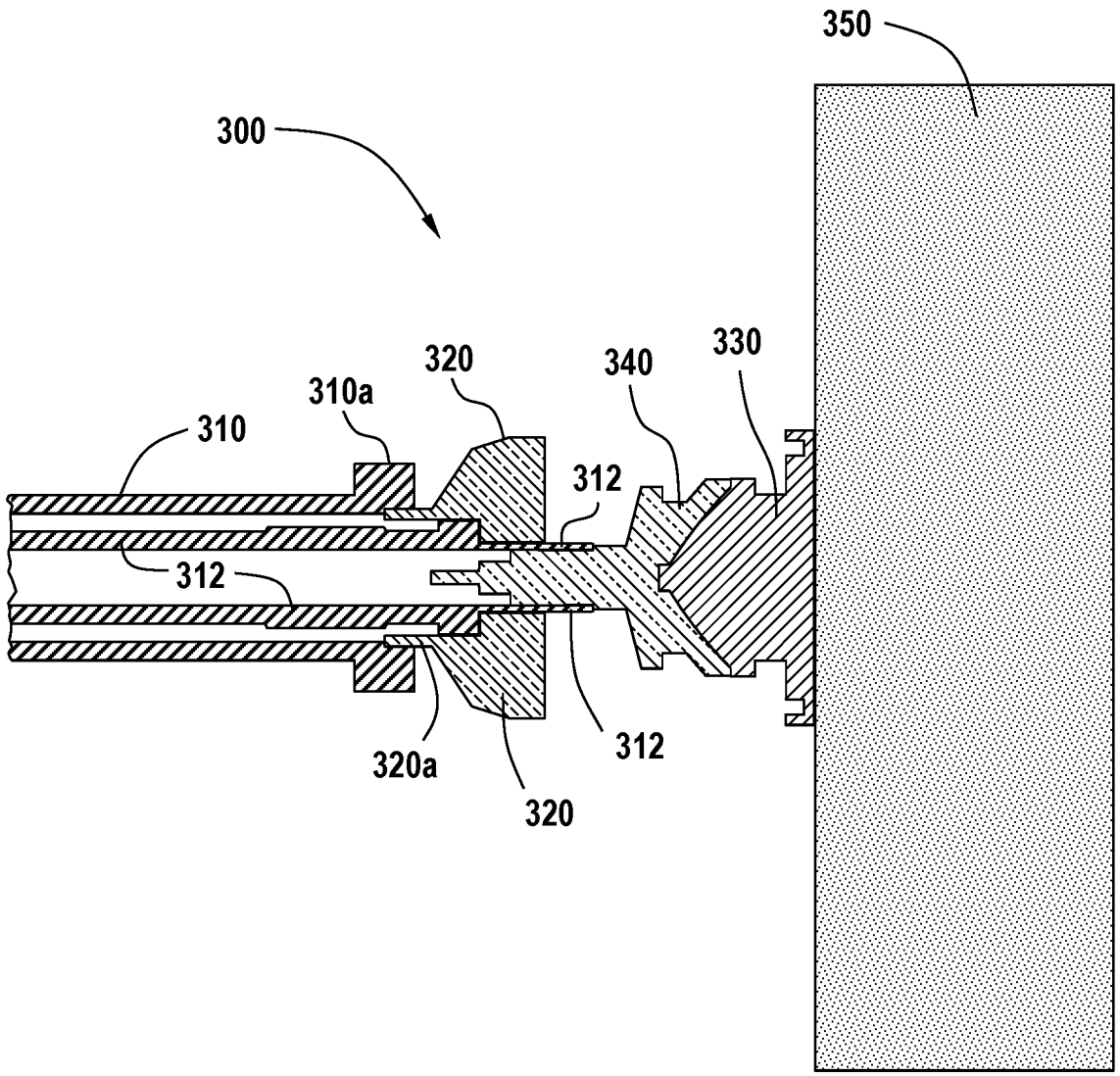
FIG. 3A is a cross-sectional view of a coaxial waveguide structure with dielectric lens, according to an embodiment of the present invention.
Figure 3B:
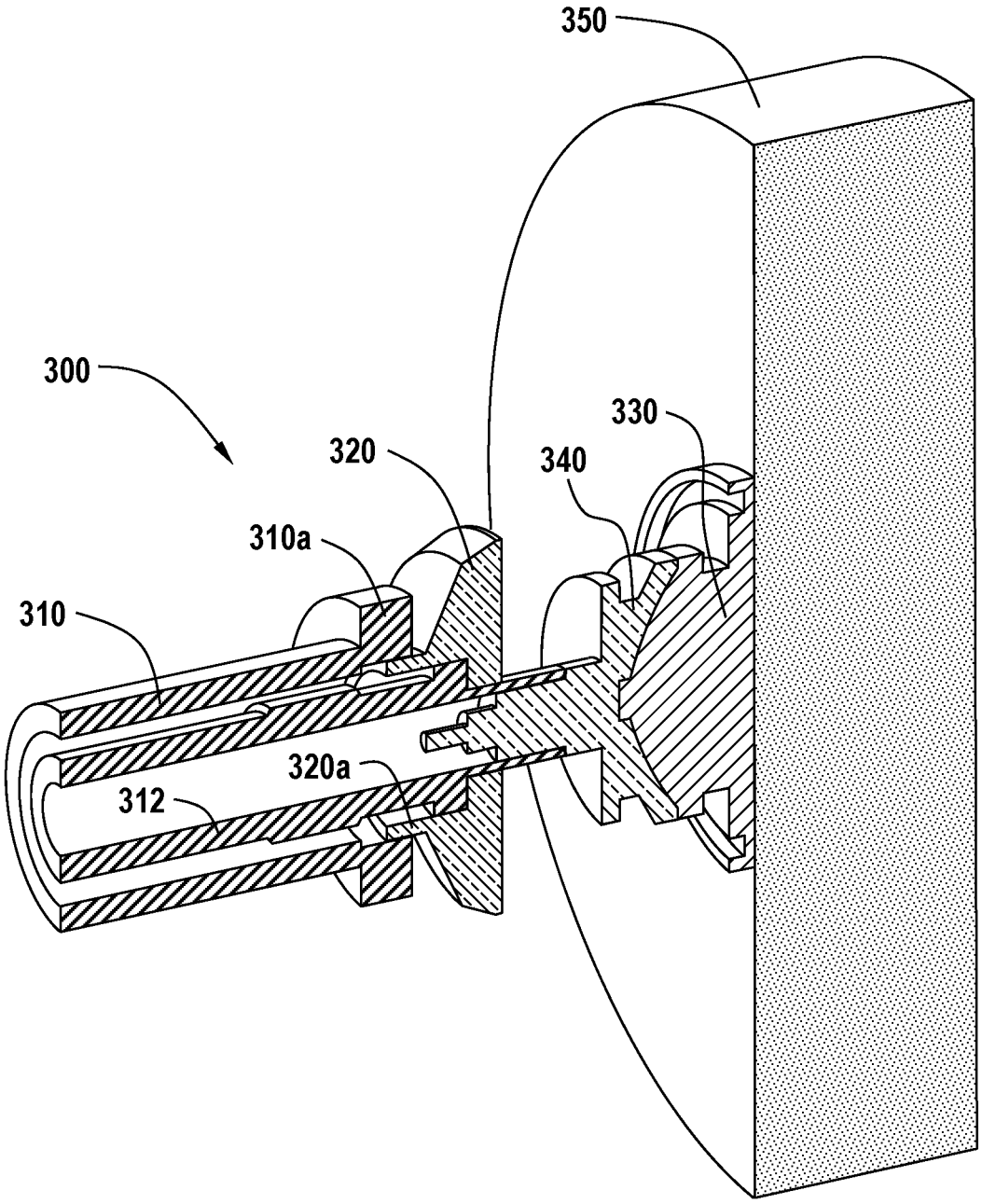
FIG. 3B a cross-sectional perspective view of a coaxial waveguide structure with dielectric lens, according to an embodiment of the present invention.
Figure 3C:
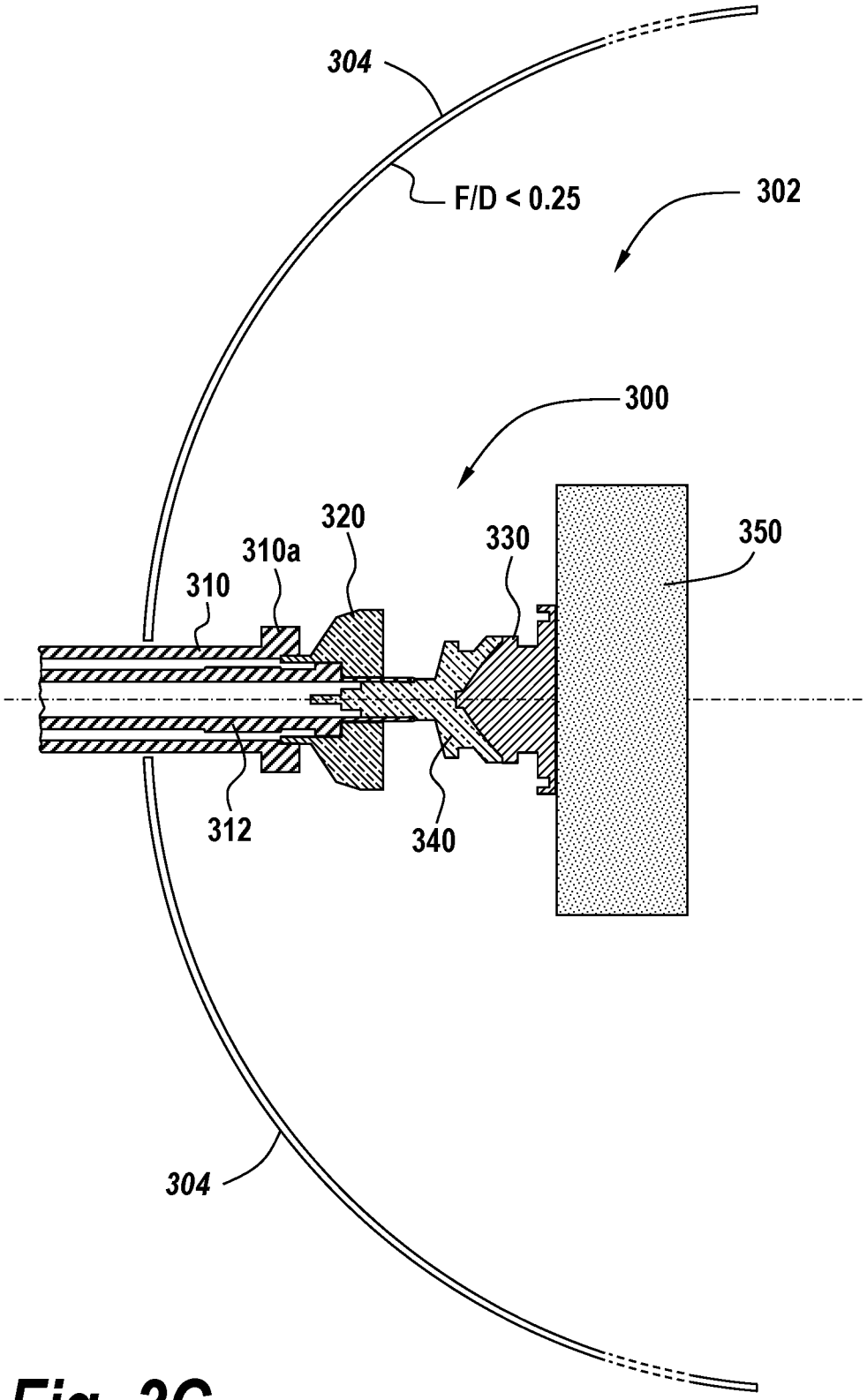
FIG. 3C is a cross-sectional view of a parabolic reflector antenna containing the coaxial waveguide structure and dielectric lens of FIGS. 3A-3B, according to an embodiment of the present invention.

Referring now to FIGS. 3A-3C, an alternative parabolic reflector antenna 302 with microwave antenna subassembly 300 is illustrated as including a relatively deep parabolic dish reflector 304 (F/D<0.25), a feed boom waveguide (310, 312) having a proximal end coupled to the dish reflector 304 and a "high frequency" sub-reflector assembly (330, 340) coupled to a distal end of the feed boom waveguide. This sub-reflector assembly is illustrated as including a dielectric block 340, which operates as a "high frequency" cone feed, a metal sub-reflector 330 adjacent a distal end of the dielectric block 340, and a lightweight RF absorber disc 350 on the metal sub-reflector. This lightweight RF absorber disc 350 may be manufactured from a precision sponge foam material that is uniformly loaded with an RF absorbing material/particles.

In addition, an annular-shaped "low frequency" dielectric lens 320 is provided on and coaxially-aligned with the inner "higher frequency" cylindrical waveguide 312, as shown. In some embodiments of the invention, the dielectric lens 320 may include an alignment spacer 320*a*, which extends between the inner "higher frequency" waveguide 312 and the outer "lower frequency" waveguide 310. For example, the inner waveguide 312 may be configured to support a 80 GHz feed signal and the outer "lower frequency" waveguide 310 may be configured to support a 23 GHZ feed signal, when used with a dish reflector 304 having a diameter of 350 mm and an F/D ratio of 0.1685.

As shown, the alignment spacer 320*a* is an annular-shaped spacer, which may be used during assembly to space apart and coaxially align the inner and outer waveguides 310, 312 relative to each other, by extending between an outer surface of the inner waveguide 312 and an inner surface of the outer waveguide 310. Moreover, a maximum outer diameter of the dielectric lens 320 may be greater than a maximum outer diameter of the dielectric block 340, and a first portion of the dielectric block 340 may be matingly received within a distal end of the inner waveguide 312. The outer cylindrically-shaped waveguide 310 may also include an outwardly projecting and annular-shaped shoulder 310*a* at its distal end, and at least a portion of the dielectric lens 320 may extend between the annular-shaped shoulder 310*a* and the metal sub-reflector 330, as shown. This annular-shaped shoulder 310*a* allows the aperture region associated with the low frequency feed signal to be tailored size wise from an RF perspective without moving components that extend within the region for the low frequency range (e.g., 23 GHz).

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A parabolic reflector antenna, comprising:

a dish reflector;

a feed boom waveguide having a proximal end coupled to said dish reflector, said feed boom waveguide comprising inner and outer waveguides in coaxial alignment;

a sub-reflector assembly comprising a dielectric block coupled to a distal end of said feed boom waveguide and a sub-reflector adjacent a distal end of the dielectric block; and a dielectric lens on said feed boom waveguide at a location intermediate the proximal and distal ends thereof, said dielectric lens surrounding a portion of the inner waveguide, but not surrounding the outer waveguide.

2. The antenna of claim 1, wherein said dielectric lens and said feed boom waveguide are in coaxial alignment.

3. The antenna of claim 1, wherein said feed boom waveguide is a dual-band waveguide.

4. The antenna of claim 1, wherein said dielectric lens is annular-shaped.

5. The antenna of claim 1, wherein said dielectric lens comprises an alignment spacer, which extends between the inner and outer waveguides.

6. The antenna of claim 5, wherein the alignment spacer is annular-shaped.

7. The antenna of claim 1, wherein said dielectric lens comprises an annular-shaped alignment spacer, which extends between an outer surface of the inner waveguide and an inner surface of the outer waveguide.

8. The antenna of claim 7, wherein a first portion of the dielectric block is matingly received within a distal end of the inner waveguide; and wherein said dielectric lens surrounds the first portion of the dielectric block.

9. The antenna of claim 1, wherein said dielectric lens comprises a cross-linked polystyrene material.

10. The antenna of claim 1, wherein the outer waveguide is cylindrically shaped and comprises an outwardly projecting and annular-shaped shoulder at its distal end.

11. A parabolic reflector antenna, comprising:

a dish reflector;

a feed boom waveguide having a proximal end coupled to said dish reflector;

a sub-reflector assembly comprising a dielectric block coupled to a distal end of said feed boom waveguide and a sub-reflector adjacent a distal end of the dielectric block; and a dielectric lens on said feed boom waveguide at a location intermediate the proximal and distal ends thereof;

wherein said feed boom waveguide comprises inner and outer waveguides in coaxial alignment; and wherein said dielectric lens surrounds a portion of the inner waveguide.

12. A microwave antenna subassembly, comprising:

a dual-band waveguide;

a dielectric lens on a portion of said dual-band waveguide; and a sub-reflector assembly coupled to a distal end of said dual-band waveguide;

wherein said dual-band waveguide comprises inner and outer waveguides in coaxial alignment; and wherein said dielectric lens surrounds a portion of the inner waveguide located adjacent the distal end.

13. The subassembly of claim 12, wherein said dielectric lens and the inner waveguide are in coaxial alignment.

14. The subassembly of claim 12, wherein said dielectric lens comprises an annular-shaped alignment spacer, which extends between the inner and outer waveguides.

15. The sub-assembly of claim 12, wherein said sub-reflector assembly comprises a dielectric block coupled to the distal end of said dual-band waveguide and a sub-reflector adjacent a distal end of the dielectric block; and wherein a maximum outer diameter of said dielectric lens is greater than a maximum outer diameter of the dielectric block.

16. The sub-assembly of claim 15, wherein a first portion of the dielectric block is matingly received within a distal end of the inner waveguide; and wherein said dielectric lens surrounds the first portion of the dielectric block.

* * * * *